US011737620B2

(12) United States Patent
Wang

(10) Patent No.: US 11,737,620 B2
(45) Date of Patent: Aug. 29, 2023

(54) TOILET BRUSH HOLDER

(71) Applicant: Ningbo Shijia Cleaning Tools Co., Ltd., Zhejiang (CN)

(72) Inventor: Yongdong Wang, Ningbo (CN)

(73) Assignee: Ningbo Shijia Cleaning Tools Co., Ltd.

( * ) Notice: Subject to any disclaimer, the term of this patent is extended or adjusted under 35 U.S.C. 154(b) by 455 days.

(21) Appl. No.: 17/024,594

(22) Filed: Sep. 17, 2020

(65) Prior Publication Data

US 2022/0022639 A1 Jan. 27, 2022

(51) Int. Cl.
*A47K 17/00* (2006.01)
*A47K 11/10* (2006.01)

(52) U.S. Cl.
CPC ..... *A47K 17/00* (2013.01); *A47K 11/10* (2013.01); *A46B 2200/304* (2013.01)

(58) Field of Classification Search
CPC .. A47K 11/10; A47K 17/00; A46B 2200/304; A46B 15/0095; A46B 17/00; A46B 17/04; B65D 1/32; A47L 13/58
See application file for complete search history.

(56) References Cited

U.S. PATENT DOCUMENTS 7,430,779 B1 * 10/2008 Garry ..... A47K 11/10 15/105
7,712,609 B2 * 5/2010 Brown ..... A47K 17/00 220/826

FOREIGN PATENT DOCUMENTS

CN 202821168 U 3/2013

* cited by examiner

*Primary Examiner* — Shay Karls

(57) ABSTRACT

A toilet brush holder comprising a holder body and a barrel body, wherein the barrel body is movably sleeved with the holder body, and an elastic member is arranged between the holder body and the barrel body. The holder body is hinged with barrel covers which are opened and closed along with up-down movement of the barrel body. The barrel body comprises an inner barrel arranged in the holder body, and the holder body comprises a ventilation hole. When the toilet brush is placed in the inner barrel, the barrel body moves down relative to the holder body, propelling the barrel covers closed at the holder body, and allowing the inner barrel to communicate with exterior of the holder body through the ventilation hole. The ventilation hole allows residual water left on the toilet brush to be quickly drained and prevents the breeding of bacteria and generation of foul smell.

6 Claims, 7 Drawing Sheets

TOILET BRUSH HOLDER

TECHNICAL FIELD

This disclosure generally relates to the technical field of bathroom products, and more particularly, to a toilet brush holder for placing a toilet brush.

BACKGROUND

A toilet brush is a sanitary appliance for cleaning a toilet, which comprises a rod-shaped handle portion and a brush head connected with one end of the handle portion. Normally, a toilet brush is equipped with a toilet brush holder for use with it. When the toilet brush isn't used anymore, it is placed in the toilet brush holder such that a convenient storage is achieved. As the residual water left on the toilet brush is prevented from dripping down on the floor, a clean and hygienic use is realized.

The Chinese patent CN202821168U discloses an automatic open-close type toilet brush holder having an inner barrel capable of moving up and down. When the toilet brush is placed into the inner barrel, its self-weight propels the inner barrel to move down, so that the inner barrel is covered by a barrel cover hinged with the inner barrel. When there is a need to use the toilet brush, the toilet brush is lifted up, and a driving device propels the inner barrel to move up, thus opening the barrel cover such that the toilet brush may be conveniently taken out. The aforesaid barrel cover capable of being opened and closed allows the toilet brush to be stored in a closed place after use. Compared with conventional toilet brushes, the aforesaid technical solution achieves a better storage effect. However, the shortcomings of the aforesaid technical solution are: when a wet toilet brush is placed in a closed space, due to the poor ventilation, the breeding of bacteria and generation of foul smell are unavoidable. Thus, it is urgent for those skilled in the art to develop a novel toilet brush holder.

SUMMARY

The purpose of the present disclosure is to provide a toilet brush holder having covers capable of being automatically opened and closed. According to the present disclosure, a good storage effect is achieved. When the toilet brush is placed in the barrel body, a ventilation hole for communicating the barrel body with the exterior is formed between the barrel covers and the barrel body. The ventilation hole enables the barrel body to be communicated with the outer air, allows the residual water left on the toilet brush to be quickly drained off, and prevents the breeding of bacteria and generation of foul smell.

To achieve the above purpose, the present disclosure adopts the following technical solution: a toilet brush holder comprising a holder body and a barrel body, wherein the barrel body is movably sleeved with the holder body, and an elastic member is arranged between the holder body and the barrel body, wherein the upper end of the holder body is hinged with barrel covers which are opened and closed along with the up-down movement of the barrel body, wherein the barrel body comprises an inner barrel arranged in the holder body, and the portion of the holder body below the barrel covers is provided with a ventilation hole, wherein when the toilet brush is placed in the inner barrel, the barrel body overcomes the elastic force of the elastic member and moves down relative to the holder body, thereby propelling the barrel covers such that they are closed at the upper end of the holder body, and allowing the inner barrel to be communicated with the exterior of the holder body through the ventilation hole.

In another aspect of the present disclosure, the holder body further comprises a base and a support arranged on the base, the ventilation hole is formed in the upper portion of the support, the barrel covers are hinged with the upper end of the support, and the inner barrel is sleeved in the support.

In another aspect of the present disclosure, the barrel body comprises an outer shell covering the exterior of the inner barrel. The support is arranged between the outer shell and the inner barrel.

In another aspect of the present disclosure, the outer shell is connected with the inner barrel through connecting walls, and the upper portion of the support is provided with avoiding grooves matched with the connecting walls.

In another aspect of the present disclosure, the connecting walls comprise inclined walls inclining upwards from interior to exterior. The barrel covers are provided with abutting portions which are in guide fit with the inclined walls. When the toilet brush is lifted up, the barrel body moves upwards relative to the holder body under the elastic force of the spring, thus enabling the abutting portions to slide along the inclined walls such that the barrels covers are turned over and opened at the upper end of the holder body.

In another aspect of the present disclosure, the positions of the barrel body corresponding to the inclined walls are provided with stopping portions. The stopping portions interact with the abutting portions to define an opening angle of the barrel covers.

In another preferred embodiment, the lower portion of the support is provided with a through hole. When the toilet brush is lifted up, the barrel body moves up relative to the holder body under the elastic force of the spring such that the interior of the holder body is communicated with the exterior through the through hole.

In another aspect of the present disclosure, the outer shell is higher than the inner barrel, and the ventilation hole is located between the upper end of the support and the upper end of the inner barrel. The through hole is located between the upper end of the base and the lower end of the outer shell. When the toilet brush is placed in the inner barrel, the lower end of the outer shell is flush with the upper end of the base, and when the toilet brush is taken out, the upper end of the outer shell is flush with the upper end of the support.

In another preferred embodiment, the elastic member is a spring, and the two ends of the spring respectively abut against the bottom of the inner barrel and the base.

In another preferred embodiment, a positioning rod extending downwards is provided in the inner barrel, and a positioning column extending upwards for allowing the positioning rod to be inserted in is arranged on the base.

Compared with the prior art, the present disclosure has the following advantages: when the toilet brush is placed in the barrel body, the weight of the toilet brush acts on the barrel body such that the barrel body overcomes the elastic force of the elastic member to move down relative to the holder body. Thus, the barrel covers are propelled to close. The toilet brush holder of the present disclosure achieves a good storage effect. Compared with the prior art, the ventilation hole is formed in the upper portion of the support below the barrel covers. When the barrel covers are closed at the upper end of the holder body, the ventilation hole is located between the lower end of the barrel covers and the upper end of the barrel body as the barrel body moves down. Thus, the inner barrel is communicated with the exterior of the holder body, and the barrel body is communicated with the outside air. By means of the aforesaid design, the residual water left on the toilet brush may be quickly drained off, so that the breeding of bacteria and generation of foul smell are avoided. When the toilet brush is lifted up, the weight of the toilet brush no longer acts on the barrel body. At this point, the barrel body moves up relative to the holder body under the elastic force of the spring such that the barrel covers are propelled to open. In this way, the toilet brush may be conveniently taken out.

Figure 1:
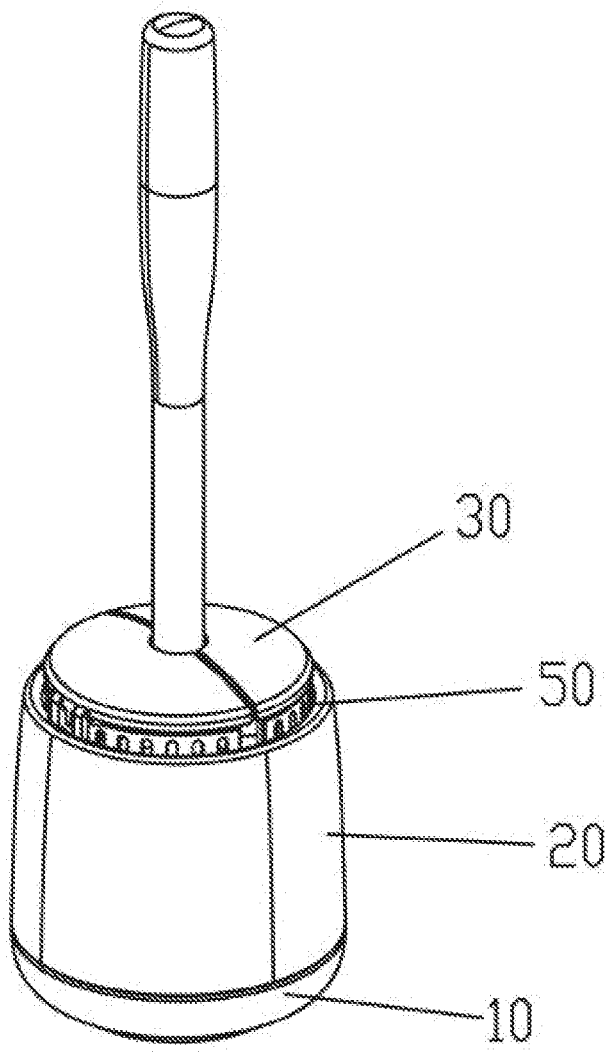
FIG. 1 is a conceptual diagram illustrating an example structure of the present disclosure when the barrel covers are closed.
Figure 2:
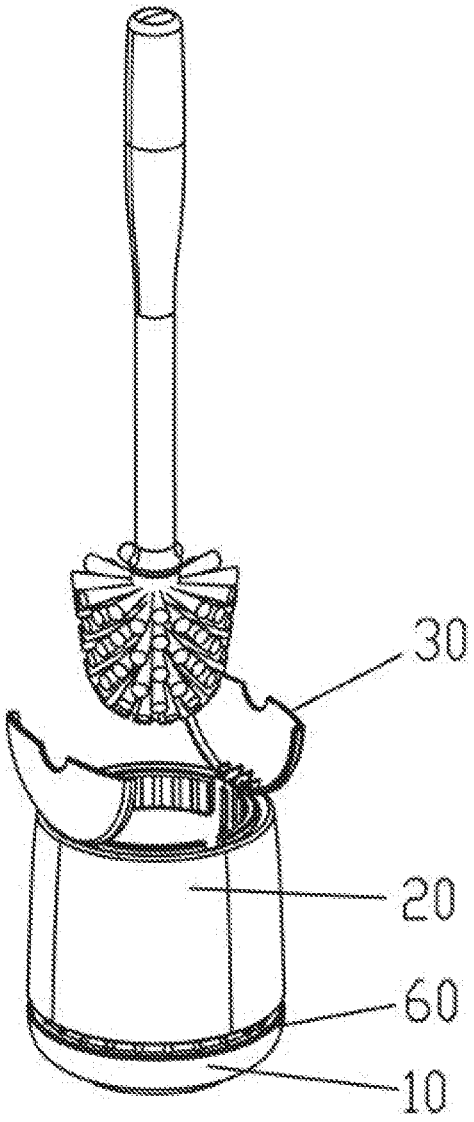
FIG. 2 is a conceptual diagram illustrating an example structure of the present disclosure when the barrel covers are opened.
Figure 3:
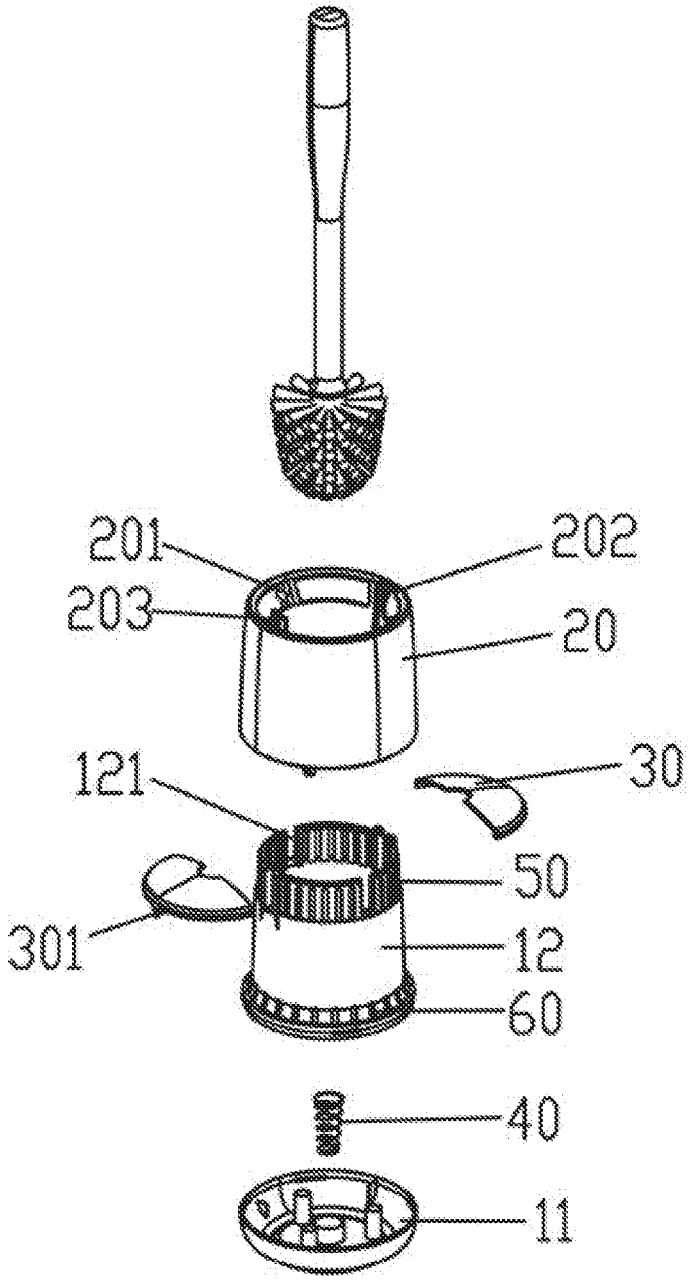
FIG. 3 is a conceptual diagram illustrating an explosive view of the present disclosure.
Figure 4:
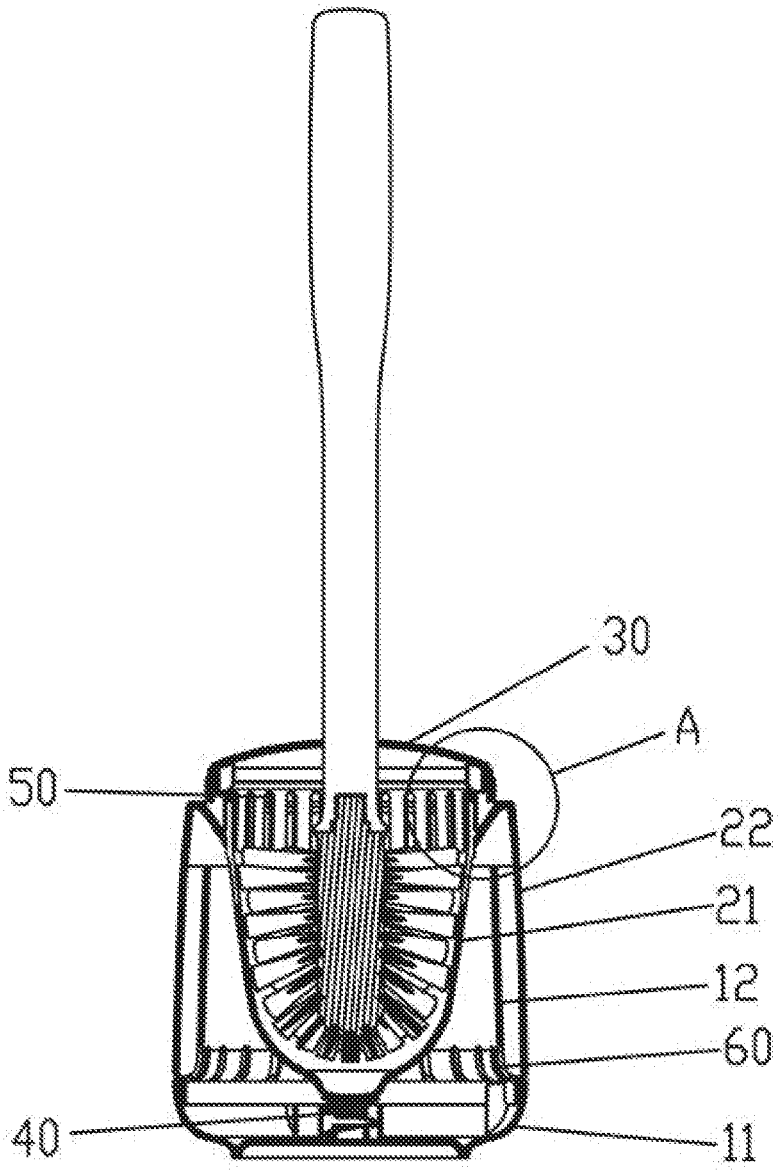
FIG. 4 is a conceptual diagram illustrating a sectional view of the present disclosure when the barrel covers are closed.

In the Figures: 10—Holder Body, 20—Barrel Body, 30—Barrel Cover, 40—Elastic Member, 50—Ventilation Hole, 60—Through Hole, 11—Base, 111—Positioning Column, 12—Support, 121—Avoiding Groove, 201—Connecting Wall, 202—Inclined Wall, 203—Stopping Portion, 2031—Stopping Convex Groove, 2032—Stopping Convex Block, 204—Positioning Rod, 21—Inner Barrel, 22—Outer Shell, 301—Abutting Portion, 3011—Abutting Convex Rod, 3012—Abutting Convex Block.

DETAILED DESCRIPTION

Figures are combined hereinafter to further elaborate the technical solution of the present disclosure.

As shown in FIGS. 1-7, a toilet brush holder comprises a holder body 10 and a barrel body 20, wherein the holder body 10 further comprises a base 11 and a support 12 arranged on the base 11. In this embodiment, the base 11 is detachably connected with the support 12, the base 11 is a bowl-shaped rotating body, and the support 12 is a cylinder structure communicated from top to bottom. The support 12 is connected to the upper portion of the base 11. Alternatively, the base 11 and the support 12 may be integrally formed.

The barrel body 20 further comprises an inner barrel 21 and an outer shell 22 covering the exterior of the inner barrel 21. The support 12 is arranged between the outer shell 22 and the inner barrel 21. In this embodiment, the outer shell 22 is connected with the inner barrel 21 through connecting walls 201, and the upper portion of the support 12 is provided with avoiding grooves 121 matched with the connecting walls 201. During assembly, the inner barrel 21 of the barrel body 20 is mounted in the support 12, and the connecting walls 201 of the barrel body 20 are assembled in the avoiding grooves 121 of the support 12, thus allowing the barrel body 20 to be movably sleeved with the holder body 10, namely, allowing the barrel body 20 and the holder body 10 to move up and down relative to each other. To make the barrel body 20 move stably relative to the holder body 10, a positioning rod 204 extending downwards may be provided in the inner barrel 21, and a positioning column 111 extending upwards for allowing the positioning rod 204 to be inserted in is arranged on the base 11. It should be noted that the outer shell 22 may partially cover the exterior of the inner barrel 21, or the barrel body 20 may not necessarily comprise the outer shell 22.

Figure 5:
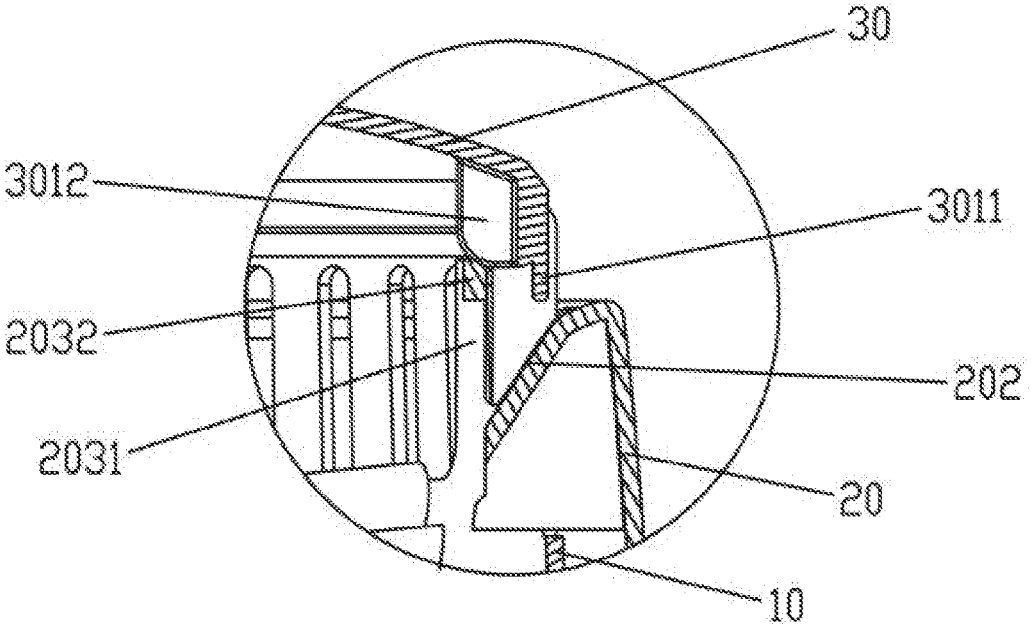
FIG. 5 is a conceptual diagram illustrating an enlarged structure of portion A in FIG. 4.
Figure 6:
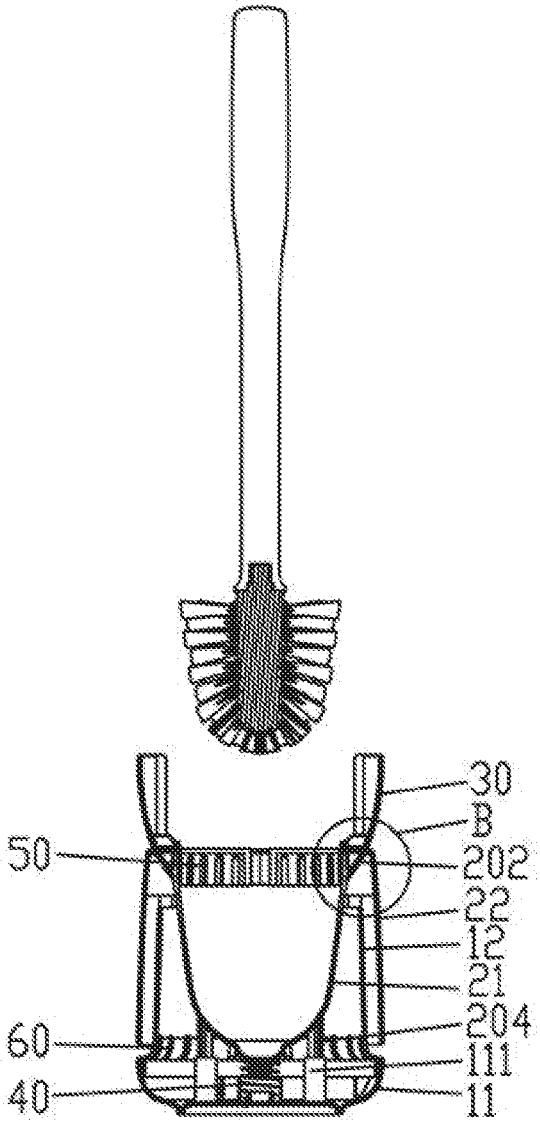
FIG. 6 is a conceptual diagram illustrating a sectional view of the present disclosure when the barrel covers are opened.
Figure 7:
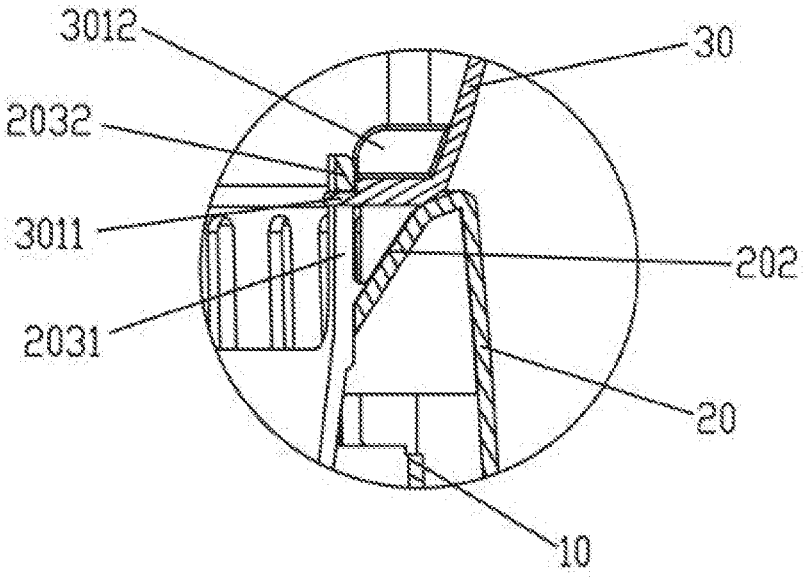
FIG. 7 is a conceptual diagram illustrating an enlarged structure of portion B in FIG. 6.

An elastic member 40 is arranged between the holder body 10 and the barrel body 20. The upper end of the holder body 10 is further hinged with barrel covers 30 which are opened and closed along with the up-down movement of the barrel body 20. More specifically, the elastic member 40 is a spring, and the two ends of the spring respectively abut against the bottom of the inner barrel 21 and the base 11. The spring force should be less than the sum of the gravity force borne by the toilet brush and the barrel body 20 but greater than the gravity force borne by the barrel body 20. Namely, when the toilet brush is placed in the barrel body 20, the barrel body 20 moves down such that the spring is in a compressed state, and when the toilet brush is taken out, the spring is reset to propel the barrel body 20 to move up. In this embodiment, four connecting walls 201 are uniformly distributed along the circumferential direction of the support 12, and the positions of the upper end of the support 12 where two opposite connecting walls 201 are located are hinged to the barrel covers 30 through pin shafts. After the two barrel covers 30 are closed, a hole for allowing the handle of the toilet brush to penetrate through is formed in the center of the two barrel covers 30, and the head portion of the toilet brush is integrally arranged in the inner barrel 21 below the barrel cover 30. The connecting walls 201 corresponding to the two barrel covers 30 form inclined walls 202 inclining upwards from interior to exterior. The barrel covers 30 are provided with abutting portions 301 which are in guide fit with the inclined walls 202, and the positions of the barrel body 20 corresponding to the inclined walls 202 are provided with stopping portions 203. The stopping portions 203 interact with the abutting portions 301 to define an opening angle of the barrel covers 30. More specifically, each abutting portion 301 comprises an abutting convex rod 3011 and an abutting convex block 3012, and each stopping portion 203 comprises a stopping groove 2031 and a stopping convex block 2032. When the toilet brush is placed in the barrel body 20, as shown in FIGS. 5 and 7, the barrel body 20 moves down, and the stopping convex blocks 2032 press against the abutting convex rods 3011, thereby pulling the barrel covers such that the barrel covers 30 are inwardly turned over and closed. When the abutting convex blocks 3012 of the barrel covers 30 press against the stopping convex blocks 2032 of the barrel body 20, the barrel covers are closed to a maximum angle. When the toilet brush is taken out, as shown in FIGS. 5 and 7, the barrel body 20 moves up, and the stopping convex blocks 2032 push up against the abutting convex blocks at the starting position, thus enabling the barrel covers 30 to be turned over and opened to a certain angle. As the barrel body 20 continues moving up, the inclined walls 202 of the barrel body 20 abut against the abutting convex rods 3011 such that the abutting convex rods 3011 slide obliquely along the inclined walls 202. In this way, the barrel covers 30 are further turned over and opened until the abutting convex rods 3011 are inserted into the stopping grooves 2031 and abut against the stopping convex blocks 2032. At this point, the barrel covers are opened to the maximum angle.

The position of the holder body 10 below the barrel covers 30 is provided with a ventilation hole 50. In this embodiment, the ventilation hole 50 is formed in the upper portion of the support 12 below the barrel covers 30. For the outer shell 22 is higher than the inner barrel 21, when the barrel covers 30 are closed at the upper end of the holder body 10, the ventilation hole 50 is located between the lower end of the barrel covers 30 and the upper end of the barrel body 20 as the barrel body 20 moves down. Thus, the inner barrel 21 is communicated with the exterior of the holder body 10, and the barrel body 20 is communicated with the outside air. By means of the aforesaid design, the residual water left on the toilet brush may be quickly drained off, so that the breeding of bacteria and generation of foul smell are avoided. It should be noted that the ventilation hole 50 may comprise a plurality of vertical strip-shaped grooves, and may be an integral gap between the two adjacent connecting walls 201.

Preferably, the lower portion of the support 12 is provided with a through hole 60. When the toilet brush is lifted up, the barrel body 20 moves upwards relative to the holder body 10 under the elastic force of the spring such that the through hole 60 communicates the interior of the holder body 10 with the exterior. The through hole 60 is located between the upper end of the base 11 and the lower end of the outer shell. When the toilet brush is placed in the inner barrel 21, the lower end of the outer shell 22 is flush with the upper end of the base 11, and when the toilet brush is taken out, the upper end of the outer shell 22 is flush with the upper end of the support 12. The through hole 60 facilitates the air circulation inside the holder body 10.

The above are merely preferred embodiments of the present disclosure, and thus all equivalent alterations or modifications made according to the structure, features and principles described in the specification of the present disclosure shall fall into the scope of the present disclosure.

What is claimed is:

1. A toilet brush holder, comprising:

a holder body, and a barrel body, wherein the barrel body is movably sleeved with the holder body, and an elastic member is arranged between the holder body and the barrel body, wherein an upper end of the holder body is hinged with barrel covers which are opened and closed along with an up-down movement of the barrel body, wherein the barrel body comprises an inner barrel arranged in the holder body, and a portion of the holder body below the barrel covers is provided with a ventilation hole, wherein when the toilet brush is placed in the inner barrel, the barrel body overcomes an elastic force of the elastic member and moves down relative to the holder body, thereby propelling the barrel covers such that they are closed at the upper end of the holder body, and allowing the inner barrel to be communicated with an exterior of the holder body through the ventilation hole;

wherein the holder body comprises:

a base and a support arranged on the base, wherein the ventilation hole is formed in an upper portion of the support, the barrel covers are hinged with an upper end of the support, and the inner barrel is sleeved in the support;

wherein the barrel body comprises:

an outer shell covering the exterior of the inner barrel, wherein the support is arranged between the outer shell and the inner barrel;

wherein the lower portion of the support is provided with a through hole, wherein when the toilet brush is lifted up, the barrel body moves up relative to the holder body under the elastic force of the spring such that the interior of the holder body is communicated with the exterior through the through hole;

wherein the outer shell is higher than the inner barrel, and the ventilation hole is located between the upper end of the support and the upper end of the inner barrel, wherein the through hole is located between the upper end of the base and the lower end of the outer shell, wherein when the toilet brush is placed in the inner barrel, the lower end of the outer shell is flush with the upper end of the base, and when the toilet brush is taken out, the upper end of the outer shell is flush with the upper end of the support.

2. The toilet brush holder of claim 1, wherein the outer shell is connected with the inner barrel through connecting walls, and the upper portion of the support is provided with avoiding grooves matched with the connecting walls.

3. The toilet brush holder of claim 2, wherein the connecting walls comprise: inclined walls inclining upwards from interior to exterior, wherein the barrel covers are provided with abutting portions which are in guide fit with the inclined walls, wherein when the toilet brush is lifted up, the barrel body moves upwards relative to the holder body under the elastic force of the spring, thus enabling the abutting portions to slide along the inclined walls such that the barrels covers are turned over and opened at the upper end of the holder body.

4. The toilet brush holder of claim 3, wherein the positions of the barrel body corresponding to the inclined walls are provided with stopping portions, wherein the stopping portions interact with the abutting portions to define an opening angle of the barrel covers.

5. The toilet brush holder of claim 1, wherein the elastic member is a spring, and the two ends of the spring respectively abut against the bottom of the inner barrel and the base.

6. The toilet brush holder of claim 5, wherein a positioning rod extending downwards is provided in the inner barrel, and a positioning column extending upwards for allowing the positioning rod to be inserted in is arranged on the base.

* * * * *